US009406475B2

(12) United States Patent
Bruchmann

(10) Patent No.: US 9,406,475 B2
(45) Date of Patent: Aug. 2, 2016

(54) MULTI-POLE SWITCH-FUSE ARRANGEMENT FOR BUSBAR SYSTEMS

(75) Inventor: Klaus Bruchmann, Coburg (DE)

(73) Assignee: Klaus Bruchmann GmbH, Weisskirchen an der Traun (AT)

( * ) Notice: Subject to any disclaimer, the term of this patent is extended or adjusted under 35 U.S.C. 154(b) by 268 days.

(21) Appl. No.: 14/352,028

(22) PCT Filed: Aug. 7, 2012

(86) PCT No.: PCT/EP2012/003372

§ 371 (c)(1),
(2), (4) Date: Apr. 15, 2014

(87) PCT Pub. No.: WO2013/056759

PCT Pub. Date: Apr. 25, 2013

(65) Prior Publication Data

US 2014/0266560 A1 Sep. 18, 2014

(30) Foreign Application Priority Data

Oct. 21, 2011 (EP) ..... 11186126

(51) Int. Cl.

| | |
|---|---|
| ***H01H 89/04*** | (2006.01) |
| ***H01H 9/10*** | (2006.01) |
| ***H01H 19/635*** | (2006.01) |
| *H01H 23/14* | (2006.01) |

(Continued)

(52) U.S. Cl.

CPC ..... *H01H 89/04* (2013.01); *H01H 9/104* (2013.01); *H01H 19/635* (2013.01); *H01H 3/06* (2013.01); *H01H 23/14* (2013.01); *H01H 23/162* (2013.01); *H01H 23/164* (2013.01)

(58) Field of Classification Search

CPC ..... H01H 3/06; H01H 9/104; H01H 19/635; H01H 23/14; H01H 23/162; H01H 23/164; H01H 89/04

USPC ..... 337/7

See application file for complete search history.

(56) References Cited

U.S. PATENT DOCUMENTS

| | | | | |
|---|---|---|---|---|
| 2,920,164 A * | 1/1960 | Edsall | ..... | H01H 9/10 337/158 |
| 3,400,353 A * | 9/1968 | Schockelt | ..... | H01H 3/30 200/50.17 |

(Continued)

FOREIGN PATENT DOCUMENTS

| | | |
|---|---|---|
| EP | 1 203 385 B1 | 7/2004 |
| EP | 2 197 010 A1 | 6/2010 |
| GB | 554 228 A | 6/1943 |

OTHER PUBLICATIONS

PCT International Search Report and Written Opinion dated Oct. 26, 2012 (translation).

(Continued)

*Primary Examiner* — Anatoly Vortman
*Assistant Examiner* — Jacob Crum
(74) *Attorney, Agent, or Firm* — Wood, Phillips, Katz Clark & Mortimer

(57) ABSTRACT

The present invention relates to a multi-pole switch-fuse arrangement having at least two switch-fuse units into which one fuse link each can be inserted. The switch-fuse arrangement comprises a switching device for closing and breaking the circuits of all switch-fuse units, the switch-fuse arrangement comprising a switching lever, a housing, a drive rod, and a lever mechanism device for actuating a drive rod.

12 Claims, 9 Drawing Sheets

(51) Int. Cl.
*H01H 23/16* (2006.01)
*H01H 3/06* (2006.01)

(56) References Cited

U.S. PATENT DOCUMENTS 4,882,556 A * 11/1989 Fujii ..... H01H 71/0257 335/8
5,856,643 A * 1/1999 Gress, Jr. ..... H01H 3/30 200/400
6,717,505 B1 * 4/2004 Bruchmann ..... H01H 85/32 337/187
6,864,443 B1 * 3/2005 Bruchmann ..... H01H 19/635 200/43.11
8,093,984 B2 * 1/2012 Hofmann ..... H01H 71/1081 218/151
2011/0221563 A1 * 9/2011 Su ..... H01H 9/104 337/149
2013/0015940 A1 * 1/2013 Dunker ..... H01H 9/104 337/12

OTHER PUBLICATIONS

EP Search Report dated Mar. 15, 2012.
PCT International Search Report and Written Opinion dated Oct. 26, 2012.

* cited by examiner

MULTI-POLE SWITCH-FUSE ARRANGEMENT FOR BUSBAR SYSTEMS

FIELD OF THE INVENTION

The present application relates to a multi-pole switch-fuse arrangement for busbar systems having at least two switch-fuse units for receiving one fuse link each.

BACKGROUND OF THE INVENTION

Such switch-fuse arrangements are in particular utilized for fusing 3-phase circuits, 3-pole switch-fuse arrangements being employed in particular.

Such a switch-fuse arrangement is for example known from EP 1 203 385 B1.

Even though switch-fuse arrangements known from the prior art already make possible some safety-promoting elements and a largely convenient and safe operation, there is a demand for further improved switch-fuse arrangements that in particular provide an improvement of the operability and comply with increased safety requirements, while the switch-fuse arrangements are at the same time designed to be simple and reliable in terms of their construction, so that the manufacturing costs for such switch-fuse arrangements can be kept low and the lifetime of a switch-fuse unit can be prolonged and wear and damage can be avoided.

BRIEF SUMMARY OF THE INVENTION

According to the invention, the switch-fuse arrangement comprises at least two switch-fuse units for receiving one fuse link each, and a contact device, preferably a contact and fastening device, for busbars. The inventive switch-fuse arrangement comprises a switch device having a switching lever that can be toggled between on and an off settings, wherein by means of this switching lever or the switch device the circuits of all switch-fuse units can be closed or broken, so that the user only has to actuate one lever to operate all switch-fuse units at the same time and synchronously.

According to the invention, the switch-fuse arrangement comprises a lever mechanism device by means of which the motion of the switching lever that can be toggled between the on and off settings, can be transferred onto a drive rod that can be moved to and fro between a contact setting and a breaker position. The drive rod is spring-loaded relative to the housing, a spring element being provided that biases the drive rod in the direction toward the breaker point.

The lever mechanism device of the switch-fuse arrangement according to the invention comprises three transfer levers, a housing transfer lever, a drive-rod transfer lever, and a switching-lever transfer lever. At its one end, the housing transfer lever is fastened to a fixed point on the housing, at its one end the drive-rod transfer lever is connected to the drive rod at a fixed point, and at its one end the switching-lever transfer lever is connected to the transfer lever or to a part of the transfer lever. The respective fastening can take place directly or indirectly, i.e. via a further intermediate element. The direct or indirect connections to the housing, the drive rod and/or the switching lever, are preferably designed to be articulated, in particular the transfer levers are rotatably attached to the relative fastening points.

The respectively other ends of the three transfer levers are interconnected in an articulated fashion, preferably at a common point or a common location/position, so that also a relative rotary motion of the three transfer elements relative to each other is made possible.

Such a lever mechanism device enables actuation of the drive rod in a particularly simple and advantageous manner, the forces are transferred effectively in a particularly advantageous manner, in particular unwanted strains being avoided leading to a smooth and controlled switching operation. This in particular ensures that the switch operations take place simultaneously with a very high degree of accuracy in all switch-fuse units.

In a particularly simple and cost-effective manner it is further ensured that clearly defined positions of the switching lever on the one hand and of the drive rod on the other hand are provided so that both an on setting and also an off setting are reliable set and maintained. It is in particular avoided that switching takes place inadvertently, possibly by accident or in the case of ambiguous switching settings.

The simple construction further leads not only to very simple and very reliable and clearly defined operation and switching, but also to a prolonged life of the entire device.

In a particularly preferred embodiment of the inventive switch-fuse arrangement, the switching-lever is of two-part design and comprises an operating element and an actuating element that can rotate relative to each other, preferably by at most a predetermined angle $\alpha$, for example between 30° and 70°, preferably 50° to 70°, particularly preferably 60° to 70°. This has the advantage that when the switching lever is moved from its on setting into the off setting, the operating lever is at first rotated by the user about an angle $\alpha$ without the actuating element being moved or forces being exerted thereon, so that a certain unloaded motion of the operating lever is achieved. This ensures that forces are not already exerted onto the drive rod by accident, for example by inadvertently touching the operating lever, which possibly leads to an unwanted breaking of the circuits of the switch-fuse units. Such an inadvertent, even very short-term, breaking of the circuits or lifting off of the contacts by a motion of the drive rod is to be avoided under all circumstances, since this can possibly also entail arcing even if the contact should be broken only very briefly, which would reduce the life of the switch-fuse unit considerably.

It is only after a rotation of the operating element or of the operating lever about a predetermined angle $\alpha$, for example 60° to 70°, in particular for example 65°, that the operating element likewise entrains the actuating element so that the lever mechanism device exerts a force on the drive rod.

In a particularly preferred embodiment, the switching-lever transfer lever is directly connected to part of the actuating element, in particular connected at a fixed point mounted rotatable thereto.

In a particularly preferred embodiment, the actuating element comprises a lever element that is fastened rotatably to the housing, in particular about a pivot that also corresponds to the pivot of the switching lever.

The end of the lever element opposite the pivot is preferably connected to an end of the switching-lever transfer lever, while the switching-lever transfer lever is connected at its opposite end to the drive-rod transfer lever and the housing transfer lever.

The cooperation of the four interconnected levers that are thus present ensures a particularly effective force transfer.

In a further preferred embodiment, the housing transfer lever and the drive-rod transfer lever are of essentially identical design, in particular they exhibit the same length. This ensures a particularly even force transfer, it is further also ensured that on manufacturing the switch-fuse arrangements and when installing the corresponding transfer levers, they cannot be mixed up. Mixing up the levers could lead to unwanted malfunctions, which might be possible if the transfer levers were of slightly differing lengths.

According to a particularly preferred embodiment, the switch-fuse unit further comprises a locking element that can be moved to and fro relative to a housing of the switch-fuse arrangement between a locking position and a release position, can be moved to and fro in particular linearly. Such a locking element ensures that a switching device or a switching lever of a switching device cannot be actuated by a user, so that the switching device or the switching lever is held or locked in its on setting and/or in its off setting. Possible incorrect operation of the device is thus avoided. This is also an aspect that on its own is inventive and that can be realized independently from the other elements, described above, of the switch-fuse arrangement and leads to advantages that are independent therefrom.

In a preferred embodiment, both the locking element and the housing exhibit an opening or a passage that overlap at least partly in the locking position of the locking element so that a lead-sealing element, in particular a lead-sealing wire, can be passed through both openings so that in its locking position the locking element is lead-sealed or secured. As a result, it can be checked and guaranteed that the switch-fuse arrangement has not been actuated without authority or accidently.

According to a further, particularly preferred embodiment the switch-fuse arrangement comprises a switching lever having an operating element and an actuating element that can be moved relative to each other, preferably be rotated relative to each other, the actuating element further exhibiting a marker and the operating element comprising a window. The operating element and the actuating element are here designed such that the marker of the actuating element is visible through the window of the operating element only if the switching lever is in its off setting. As a result of a particular advantageous design of the switch-fuse arrangement, in particular in the form as described above, in particular having an inventive lever mechanism device, it is also safeguarded automatically that the switch-fuse units and the switch-fuse arrangement are contactless or de-energized if the marker is visible through the window. In this way, particularly increased safety requirements are fulfilled, in particular faulty operation is avoided.

This particular embodiment of a switching lever having an actuating element with a marker and an operating element with a window is on its own inventive also independently of the further design of the switch-fuse arrangement as described above, and it is an independent inventive aspect of a multi-pole switch-fuse arrangement.

These and further features and advantages of the invention become apparent using the appended drawings that show particularly advantageous embodiments.

DETAILED DESCRIPTION OF THE PREFERRED EMBODIMENTS

Figure 1:
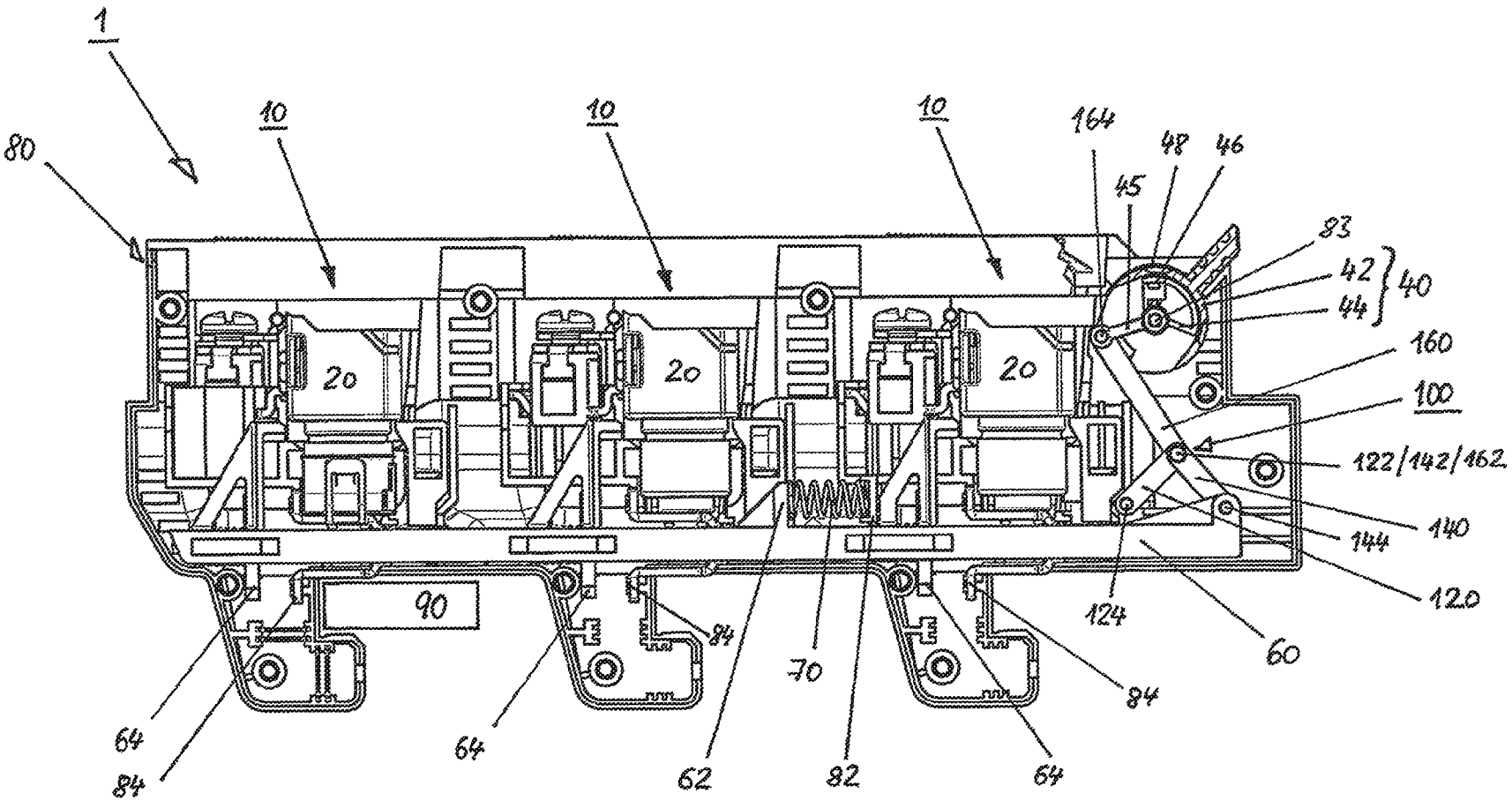
FIG. 1 shows a cross section through an embodiment of a multi-pole switch-fuse arrangement, the switch-fuse arrangement being in its breaker setting.

FIG. 1 shows an embodiment of an inventive switch-lock arrangement 1, this switch-lock arrangement 1 being a 3-pole switch-fuse arrangement 1 that comprises a total of three switch-fuse units 10 into which one fuse link 20 each can be inserted and, as FIG. 1 shows, is inserted.

The switch-fuse arrangement 1 comprises a housing 80 and is designed such that it can be fastened on a busbar system that in the case of the 3-pole design comprises a total of three busbars, only one busbar 90 being diagrammatically illustrated in FIG. 1. The switch-fuse arrangement 1 comprises a switching device having a switching lever 40 that can be toggled between an on setting and an off setting, the switching lever 40 in FIG. 1 being in its off setting.

In the embodiment shown in FIG. 1, the switching lever 40 is of two-part design and comprises an operating element 42 (see in detail also FIG. 4) and an actuating element 44. The actuating element 44 exhibits a marker 46 that in the off setting shown in FIG. 1 is visible through a window 48 of the operating element so that the status of the switch-fuse arrangement is indicated to the user. This visibility of the marker 48 that is for example implemented by a green field tells the user that the switch-fuse arrangement is in a contactless or de-energized state so that for example fuse links can be replaced.

Figure 3:
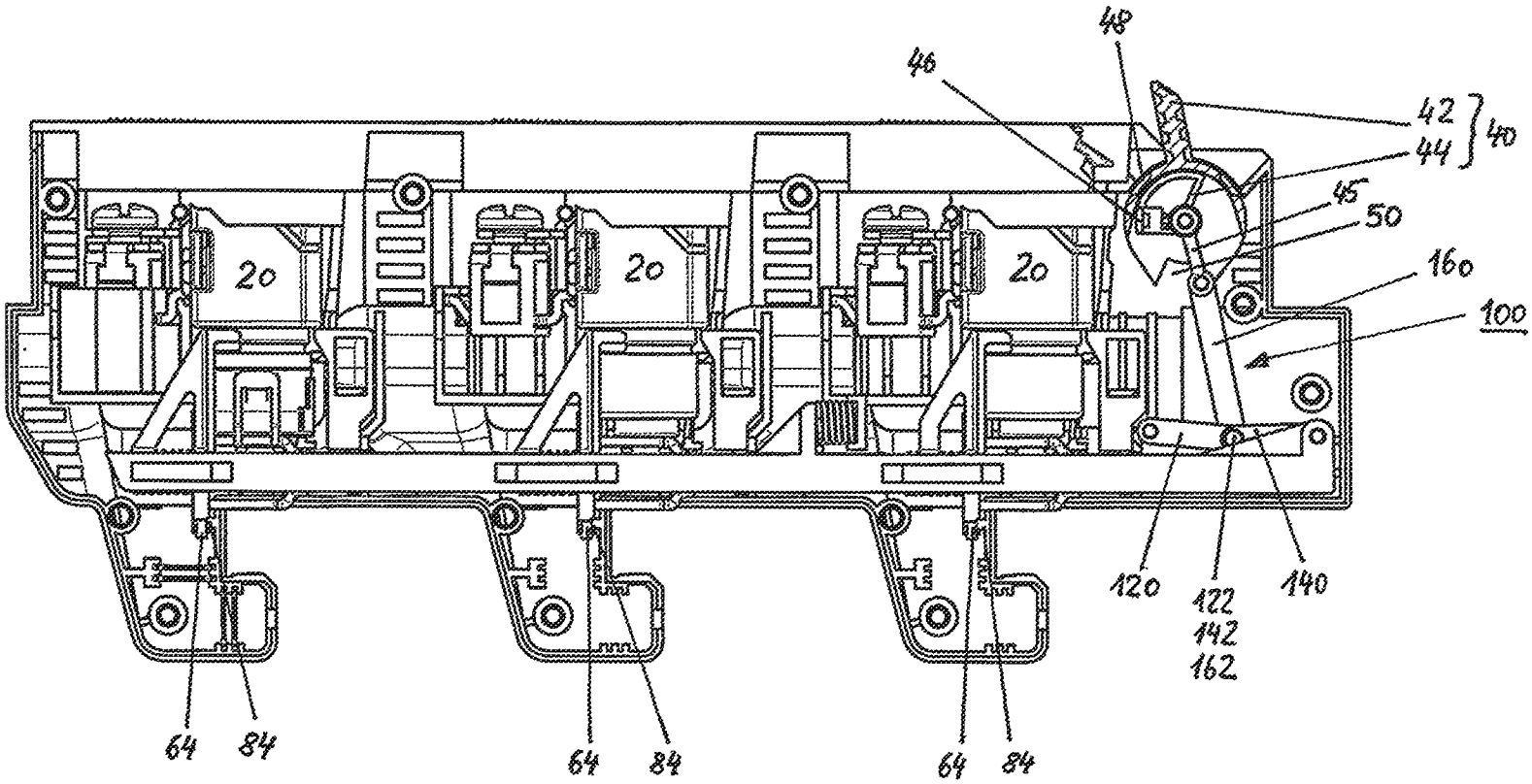
FIG. 3 shows the embodiment of the switch-fuse arrangement illustrated in FIGS. 1 and 2, the switch-fuse arrangement being in a state in which a user has moved the switching lever from an on setting in the direction of the off setting into an intermediate setting.
Figure 3A:
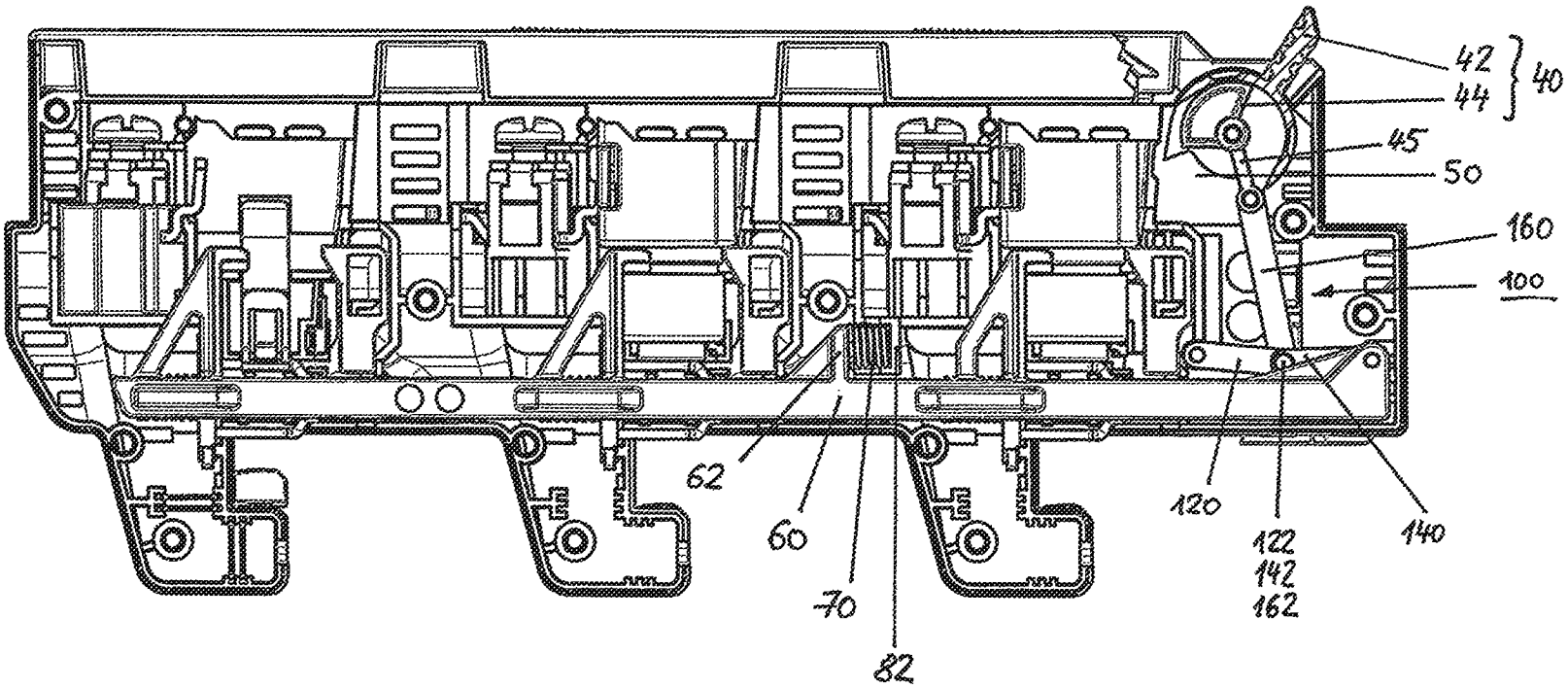
FIG. 3A shows a further embodiment of the switch-fuse arrangement, this further embodiment being in a state in which a user has moved the switching lever from an on setting in the direction of the off setting into an intermediate setting.

The operating lever 42 and the operating element 44 are rotatably mounted on the housing 80, in addition a relative rotary motion being possible about a maximum predetermined angle $\alpha$ between the actuating element 42 and the operating element 44, this in particular in the case of a de-energizing procedure offering particular advantages, see in particular the following description for FIGS. 3 and 3A.

The switching lever 40 is connected to a lever mechanism device 100 that again is connected to a drive rod 60, so that actuating the switching lever 40 from the on setting into the off setting or vice versa transfers a force and a motion onto the drive rod 60 that is designed to be linearly movable to and fro between a contact setting and a breaker setting, in FIG. 1 in a horizontal direction from left to right and vice versa.

In this embodiment, the operating element 44 of the switching lever 40 comprises a lever arm 45 that is mounted on a pivot 83 so as to be rotatable relative to the housing 80 and whose other end is connected in an articulated manner to the switching-lever transfer lever 160. By means of this additional lever arm 45, the force exerted by the user on the switching lever 40 is transferred particularly effectively onto the lever mechanism device 100.

In FIG. 1, the switching lever 40 is in its off setting with the result that also the drive rod is in its breaker setting, on the left in FIG. 1, the drive rod 60 being biased by means of a spring device 70 into this breaker setting. In the case of the embodiment shown in FIG. 1, the spring element 70 is implemented by a helical spring that is arranged between a projection 62 of the drive rod 60 and a projection 82 of the housing 80. Of course it is possible to provide other spring elements and/or also more than one spring element.

After the drive rod 60, in the setting shown in FIG. 1, is in its in breaker setting, the three contacts 64 that are arranged on the drive rod or connected to it and at least partly follow the linear motion of the drive rod, are separate from the associated contacts 84 so that the switch-fuse arrangement is in a de-energized or contactless state. The lever mechanism device 100 comprises a total of three transfer levers, a house transfer lever 120, a drive-rod transfer lever 140, and a switching-lever transfer rod 160, that are connected at their respective one end 122, 142, 162 in an articulated manner.

At a point 124, the other end of the housing transfer rod 120 is connected to the housing in an articulated manner. The other end of the drive-rod transfer lever 140 is connected at one point 144 to the drive rod 60 in an articulated manner. At a point 164, the other end of the switching-lever transfer lever 160 is connected to the actuating element 44 of the switching lever 40.

Figure 2:
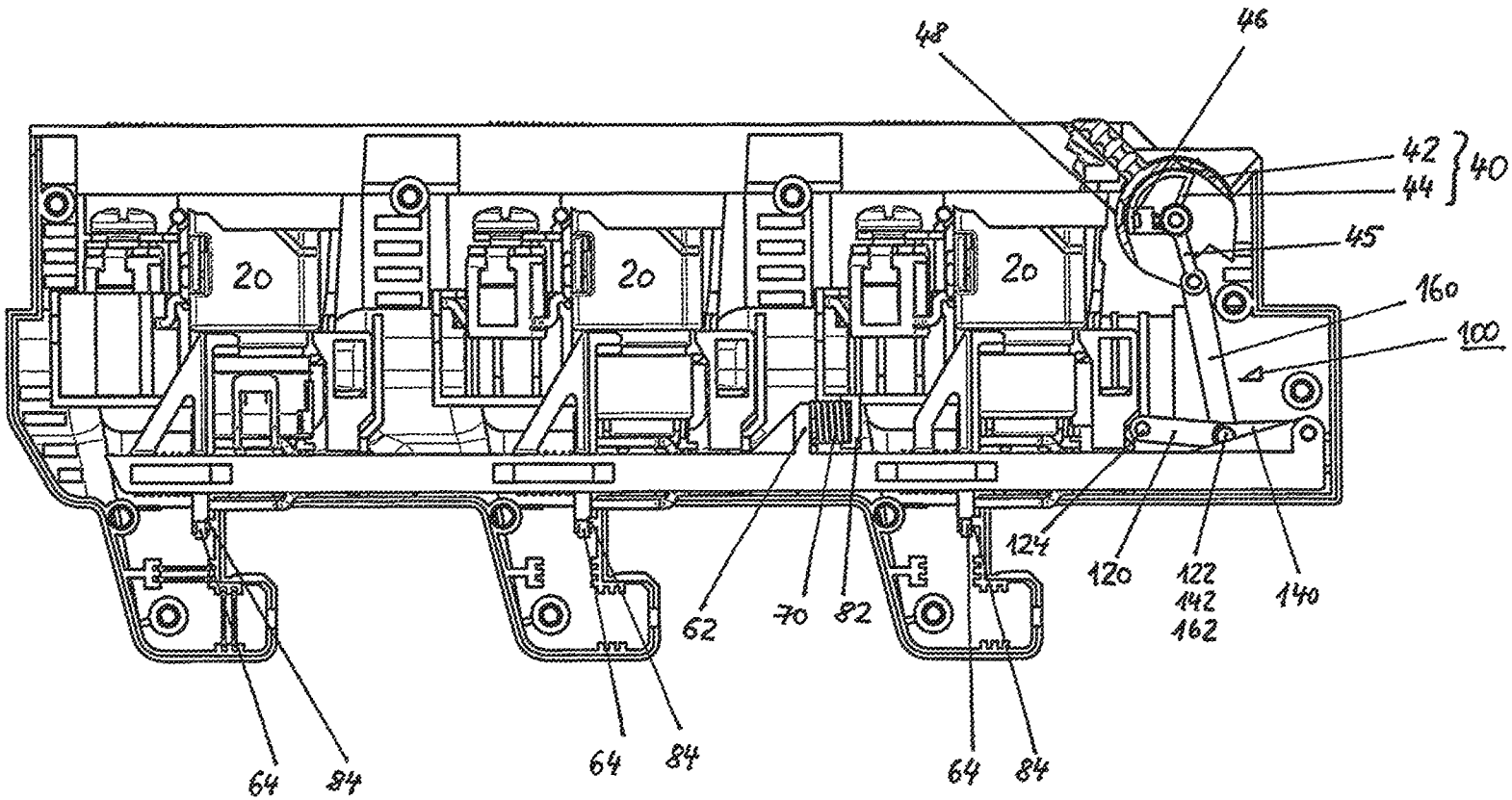
FIG. 2 shows the embodiment of the circuit fuse arrangement illustrated in FIG. 1, the switch-fuse arrangement being in its contact setting or operating setting.

FIG. 2 illustrates the embodiment of the switch-fuse arrangement 1 shown in FIG. 1, however the switching lever 40 is in its on setting and the switch-fuse unit is in its contact setting or operating setting.

In comparison to the setting shown in FIG. 1, the operating lever 42 of the switching lever 40 has been moved by a user toward the left or counter-clockwise into its on setting. This motion also rotated the actuating element 44, in the view shown in FIG. 2 counter-clockwise, so that a force was exerted on the lever mechanism device 100. The switching-lever transfer lever 160 has in this case exerted a force via the common contact point 122, 142, 162 of the three transfer levers onto the housing transfer lever 120 and the drive-rod transfer lever 140, so that on account of the fact that the housing transfer lever 120 is firmly connected to the housing 80 at a point 124 the drive rod has been pressed into the contact setting counter to the spring force of the spring device 70. This leads to the contacts 64 and 84 contacting each other so that the switch-fuse arrangement is in its operating setting or contact setting.

In this on setting, the common connection point 122, 142, 164 of the three transfer levers 120, 140, 160 has been pushed beyond a dead center position, so that the force exerted by the spring device 70 via the drive rod 60 acts on the housing transfer lever 120 and the drive-rod transfer lever 140 in a direction that presses the switching-lever transfer lever 160 in FIG. 2 downward so that in this position the spring force of the spring device 70 keeps the switch-fuse arrangement in its contact setting or operating setting.

FIG. 3 shows the switch-fuse arrangement illustrated in FIGS. 1 and 2, where a user has moved the operating lever 42 from the on setting shown in FIG. 2 through an angle $\alpha$ in the direction of the off setting. As can be clearly seen in FIG. 3, this motion of the operating element 40 about the angle $\alpha$ is not transferred immediately onto the operating element 44, therefore the operating element 44 and thus the lever mechanism device 100 are still in the position shown in FIG. 2.

It is not until after the setting shown in FIG. 3 and on further rotation of the operating element 42 toward the off setting, clockwise in FIG. 3, that the actuating element 44, too, is actuated by the operating element 42, in this case entrained, so that also the actuating element 44 moves into the off setting, clockwise in FIG. 3, as a result of which the lever mechanism device is again brought into the position shown in FIG. 1 which is supported by the spring force of the spring element 70, as soon as the dead center point has been overcome.

FIG. 3A shows a further embodiment of an inventive switch-fuse arrangement that is very similar to the switch-fuse arrangement shown in FIG. 3, so that reference is made to the description above. Identical or similar elements have been provided with identical reference symbols.

In the embodiment shown in FIG. 3A, the operating lever 42 and the operating element 44 of the switching lever 40 are engineered such that the angle $\alpha$ is larger than in the embodiment shown in FIG. 3. As can be seen in FIG. 3A, moving the operating element 42 will therefore at a later point in time transfer this motion onto the operating element 44. Even in the position of the operating lever 42 shown in FIG. 3A, the lever mechanism device 100 is therefore still in the position that corresponds to the position shown in FIG. 2, so that the drive rod 60 is still in its contact setting.

Figure 4:
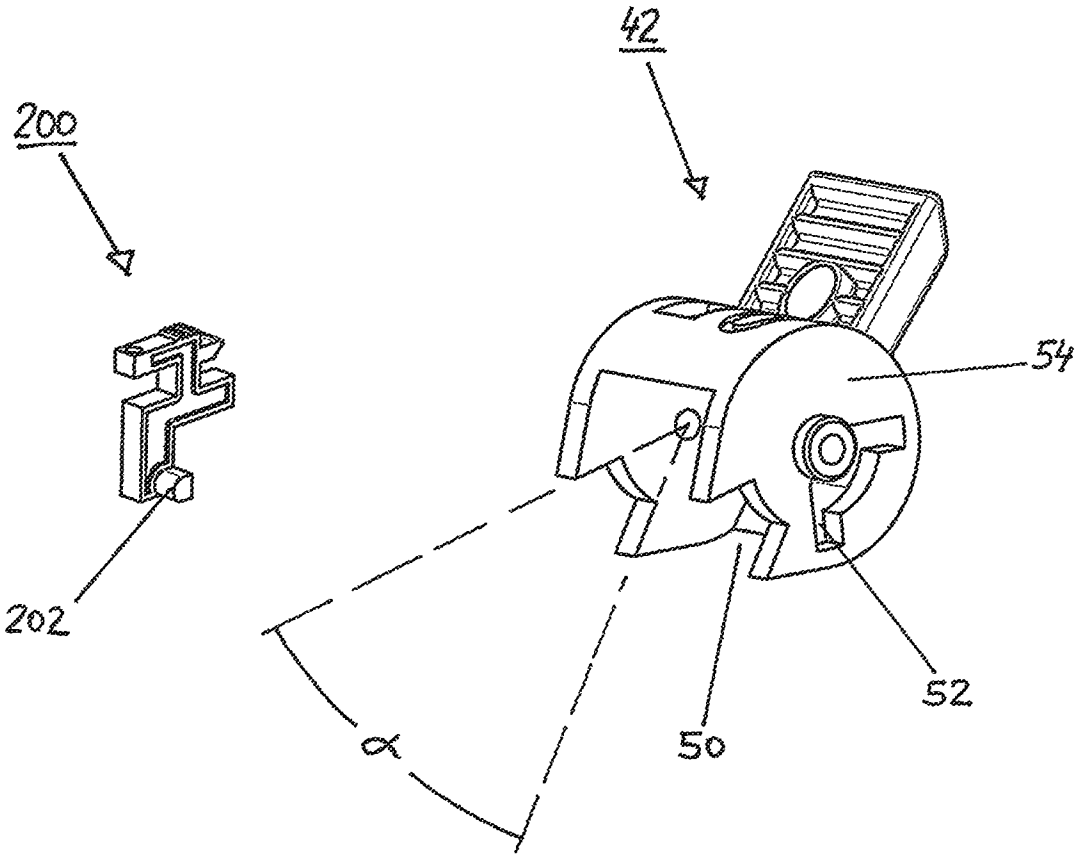
FIG. 4 shows a switching lever and a locking element as they can be used in an embodiment of a switch-fuse arrangement according to the invention.

FIG. 4 shows a perspective view of the operating element 42 and of a locking element 200 as they can be utilized in a switch-fuse arrangement as illustrated in FIG. 1 to 3 or 3A.

The operating element 42 of the switching lever (40, see FIGS. 1 to 3) comprises two side areas or side walls 54 that in each case are provided with a recess 50, the recess 50 extending over an angular range $\alpha$. This angular range $\alpha$ defines the maximum relative rotary motion between the operating element 42 and an actuating element (44, see FIGS. 1 to 3). There is further incorporated into a side wall 54 of the operating lever 42 a guide groove into which a projection 202 of the locking element 200 engages. With regard to the functions, reference is made to the following descriptions of FIGS. 5 to 7.

The angular range $\alpha$ can be matched to the desired device, in particular the operability of the device can be adapted in this way. The angle $\alpha$ can be selected in a wide range, for example between 30° and 70°, however larger angular ranges, in particular between 60° and 70°, being preferred.

Figure 5:
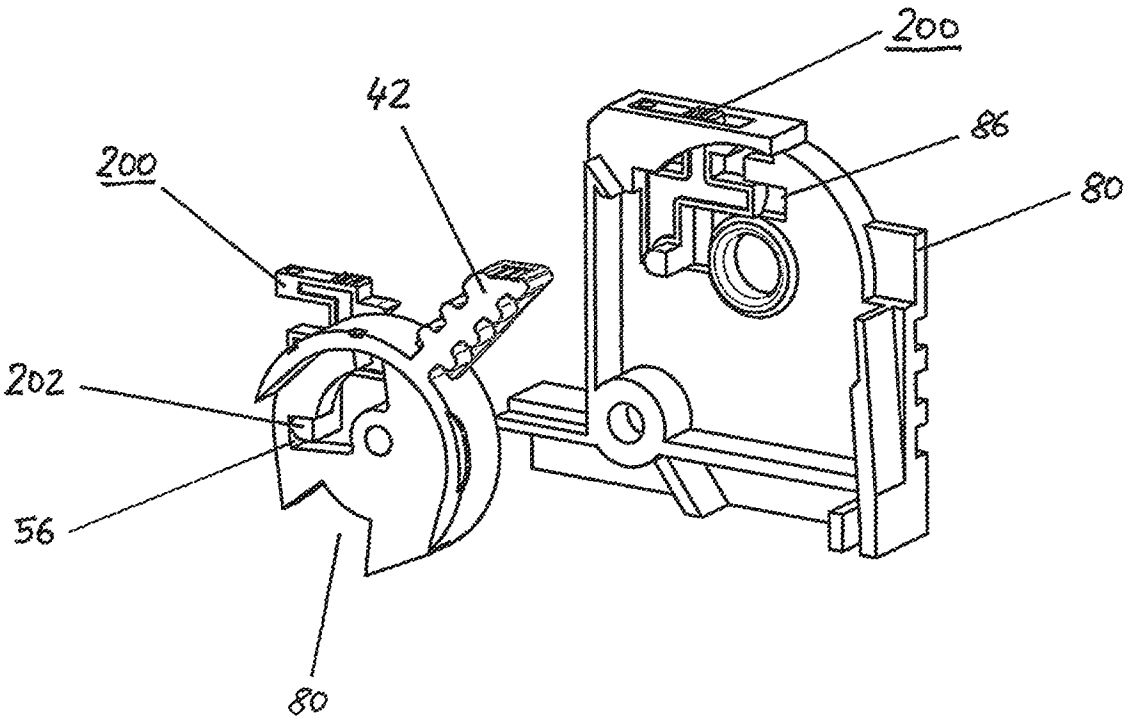
FIG. 5 shows an illustration of a switching lever and of a locking element with parts of a housing of a switch-fuse arrangement according to the present invention, the switching lever being in an off setting.
Figure 6:
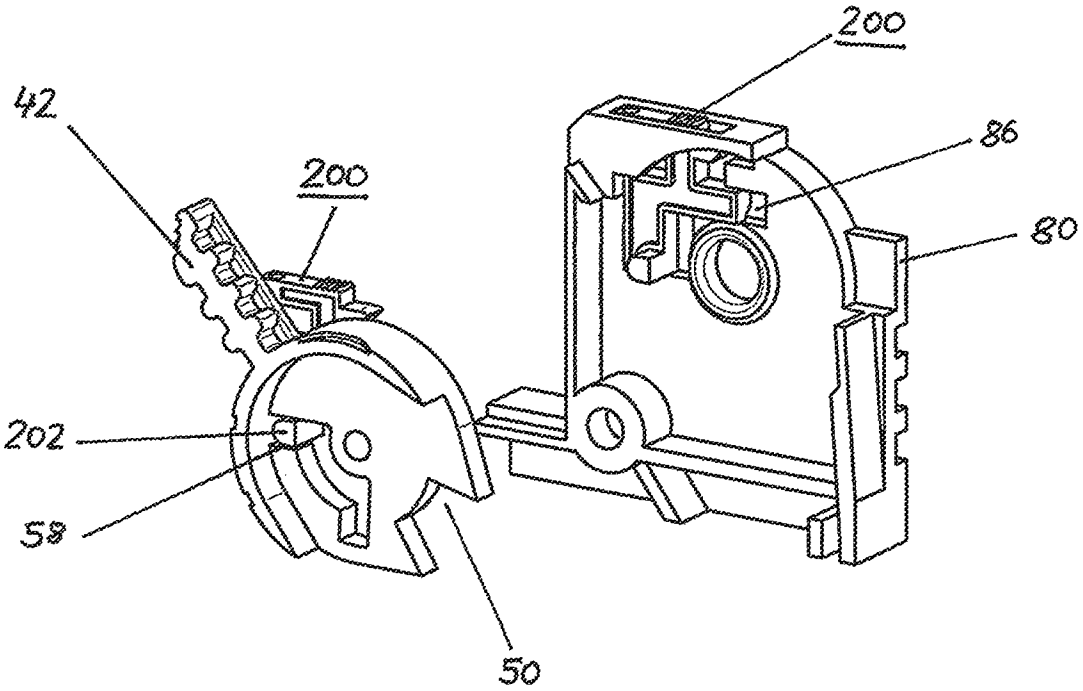
FIG. 6 shows an illustration of a switching lever and of a locking element with parts of a housing of a switch-fuse arrangement according to the present invention, the switching lever being in an on setting.
Figure 7:
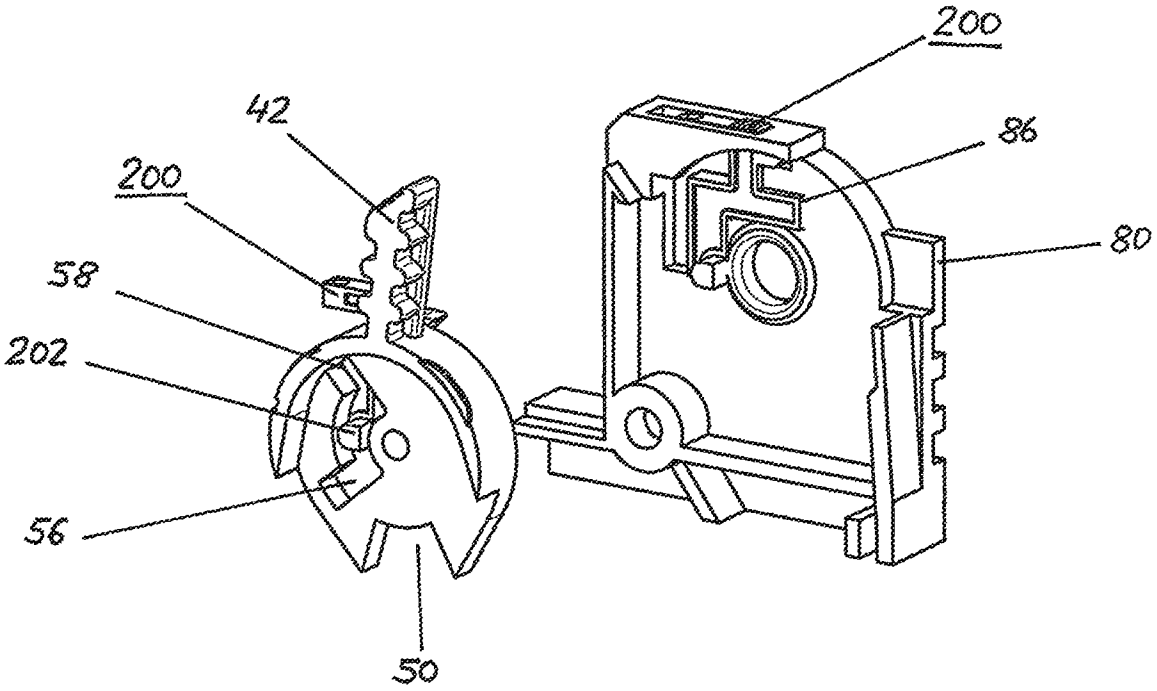
FIG. 7 shows an illustration of a switching lever and of a locking element with parts of a housing of a switch-fuse arrangement according to the present invention, the switching lever being in an intermediate setting.

FIGS. 5 to 7 show part of the housing 80 and part of the operating lever 42 in an exploded view, the locking element 200 being illustrated twice for reasons of clarity, i.e. once in relation to the operating element 42 and once in relation to that part of the housing 80 in which the locking element 200 likewise moves.

FIG. 5 shows a state in which the operating element 42 is in its off setting, FIG. 6 shows a state in which the operating element 42 is in an on setting, and FIG. 7 shows a state in which the operating element is in an intermediate setting.

FIG. 5 shows the operating element 42 in the off setting in which the operating element 42 and the locking element 200 are in such a relative position that the projection 202 of the locking element 200 can move into a first latching recess 56 of the guide groove 52 so that the locking element 200 can be moved into a locking position. If the locking element 200 is situated in the locking position, as shown in FIG. 5, the operating element 42 can no longer be rotated and cannot be moved out of its off setting. If the user wants to move the operating element into the on setting, they must first move the locking element 200 out of the first latching recess 56, i.e.

move it in FIG. 5 toward the right, this motion taking place in corresponding guide grooves 86 of the housing 80 provided for this purpose.

FIG. 6 shows the elements illustrated in FIG. 5, however the operating lever 42 being in its on setting. The locking element 200 is likewise in its locking position, but now the projection 202 of the locking element 200 engages in a second latching recess 58 of the guide groove 52 of the operating element 42. In this position, too, of the locking element 200 the operating element 42 cannot be moved so that accidently switching off or moving the operating element 42 into its off setting is avoided.

FIG. 7 shows the elements illustrated in FIGS. 5 and 6, the operating lever 42 however being in an intermediate setting between the on setting and the off setting. So that the operating element can be in this intermediate setting or can be moved from the on setting into the off setting or vice versa, the locking element 200 must be in its release position, i.e. it must have been moved in FIG. 7 in the guide grooves 86 of the housing toward the right. In this position, the projection 202 of the locking element 200 rests against the guide groove 52 and cannot engage in one of the latching recesses 56 or 58 so that the locking element cannot be moved into the locking position.

Figure 8:
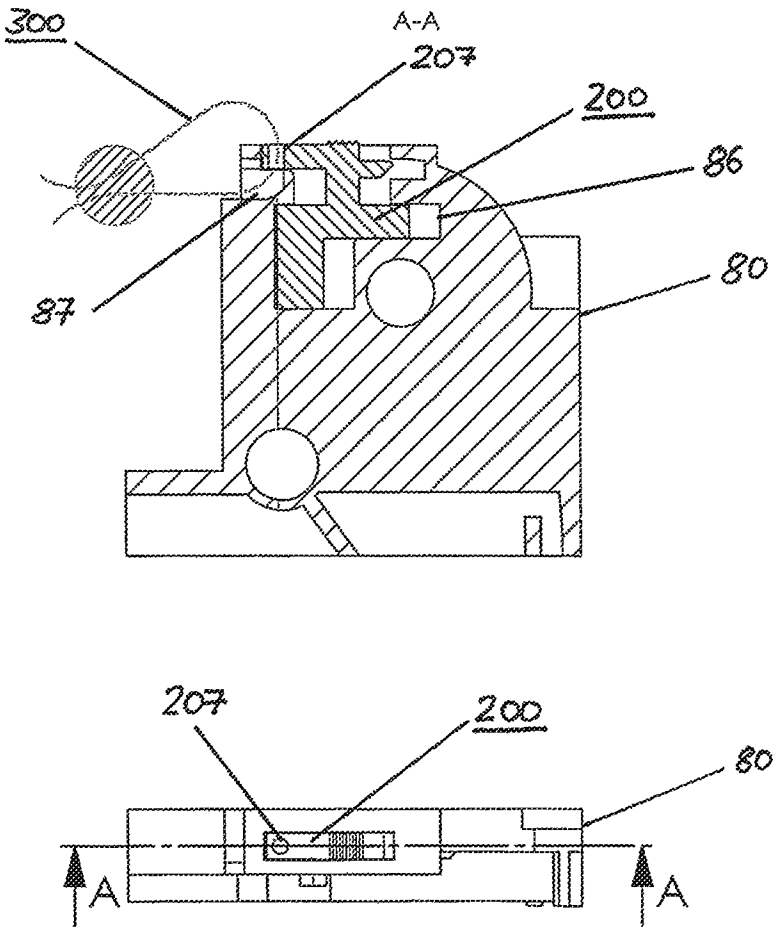
FIG. 8 shows a top view of part of a housing of a switch-fuse arrangement having a locking element and a cross-sectional view along the line A-A.

FIG. 8 shows a top view of the parts, illustrated in FIGS. 5 to 7, of the housing 80 and the locking element 200 and a cross-sectional view along the line A-A. The locking element 200 is in a locking position so that an opening 207 provided in the locking element 200 is aligned with an opening 87 provided in the housing 80, so that a lead-sealing wire can be fed through both openings. This ensures that the locking element 200 cannot be moved into its release position without destroying the lead-sealing wire.

The features disclosed in the description above, the figures, and the claims can be important both individually and in any combination for implementing the invention in the different designs.

What is claimed is:

1. A multi-pole switch-fuse arrangement for busbar systems having at least two switch-fuse units (10) for receiving one fuse link (20) each and having a contact device for busbars (90), a housing (80), a switch device for closing and breaking the circuit of all switch-fuse units (10), a switching lever (40) switchable between an on setting and an off setting, and a drive rod (60) switchable between a contact setting and a breaking setting, a spring device (70) between the housing (80) and the drive rod biasing the drive rod toward its breaking setting, comprising a lever mechanism (100) connecting the switching lever (40) to the drive rod (60), the lever mechanism (100) including, a housing transfer lever (120) connected in an articulated manner at one end to the housing (80), a drive-rod transfer lever (140) connected at one end in an articulated manner to the drive rod (60), and a switching-lever transfer lever (160) connected at one end to the switching lever (40) in an articulated manner, the respectively opposite ends of each of the transfer levers (120, 140, 160) being interconnected in an articulated manner, so that a force is exerted on the drive rod (60) when the switching lever (40) is moved from its off setting into its on setting by means of the lever mechanism (100), whereby the drive rod (60) moves counter to the spring force of the spring device (70) in a longitudinal direction relative to the housing (80) from its breaking setting into its contact setting.

2. The switch-fuse arrangement according to claim 1, wherein the lever mechanism (100) is moved beyond a dead center point by the switching lever (40) when the switching lever (40) is moved from its off setting into its on setting, whereby in this position of the lever mechanism the drive rod (60) is held in the contact setting by the force of the spring device (70).

3. The switch-fuse arrangement according to claim 1 wherein the switching lever (40) comprises an operating element (42) and an actuating element (44), the operating element (42) and the actuating element (44) being rotatable relative to each other about a predetermined maximum angle $\alpha$.

4. The switch-fuse arrangement according to claim 3, wherein the switch-lever transfer lever (160) is connected to the actuating element (44) of the switching lever (40).

5. The switch-fuse arrangement according to claim 4 wherein the actuating element (44) comprises a lever element (45) rotatable relative to the housing (80) about a pivot (83) and connected at its opposite end (164) in an articulated manner to the switching-lever transfer lever.

6. The switch-fuse arrangement according to claim 1, wherein the housing transfer lever (120) and the drive-rod transfer lever (140) have the same length.

7. The switch-fuse arrangement, according to claim 1, wherein the switching lever (40) is rotatable in the housing (80) between an on setting and an off setting, and includes a locking element (200) switchable between a locking position and a release position, the switching lever (40) being locked in its position if the locking element (200) is in its locking position, and the locking element (200) can only be moved into the locking position if the switching lever (40) is in its on setting or in its off setting.

8. The switch-fuse arrangement according to claim 7, wherein the locking element (200) is connected to the housing (80) for linear movement relative to the housing (80) between the locking position and the release position.

9. The switch-fuse arrangement according to claim 7 wherein the locking element (200) has a through opening (207) and the housing (80) has a through opening (87) that are wherein said through openings (207, 87) are at least partly mutually aligned in the locking position of the locking element (200), whereby a lead-sealing element can be passed through both openings (87, 207), and the locking element (200) cannot be moved out of the locking position if the lead-sealing element has been passed through said through openings (87, 207).

10. The switch-fuse arrangement, according to claim 1, wherein the switching lever (40) comprising an operating element (42) and an actuating element (44) rotatable relative to each other about a maximum angle $\alpha$, the actuating element (44) being at least partly arranged inside the operating element (42) and having a marker (46), and the operating element (42) has a window (48), the marker (46) being visible in the window (48) only when the switching lever (40) is in its off setting.

11. The switch-fuse arrangement according to claim 10, wherein in the on setting of the switching lever (40) the window (48) is covered by parts of the housing (80) of the switch-fuse arrangement.

12. The switch-fuse arrangement according to claim 10 wherein the marker (46) is not visible in the window (48) unless the drive rod (60) is in its breaking setting.

* * * * *